US007989724B2

(12) United States Patent
Altmann et al.

(10) Patent No.: US 7,989,724 B2
(45) Date of Patent: Aug. 2, 2011

(54) SWITCH, PARTICULARLY WINDOW LIFTER SWITCH

(75) Inventors: Markus Altmann, Moos-Bankholzen (DE); Juergen Schmider, Wolfach (DE); Peter Schulte, Radolfzell-Boehringen (DE)

(73) Assignee: TRW Automotive Electronics & Components GmbH, Radolfzell (DE)

( * ) Notice: Subject to any disclaimer, the term of this patent is extended or adjusted under 35 U.S.C. 154(b) by 0 days.

(21) Appl. No.: 12/290,804

(22) Filed: Nov. 4, 2008

(65) Prior Publication Data

US 2009/0114517 A1 May 7, 2009

(30) Foreign Application Priority Data

Nov. 5, 2007 (DE) ..... 10 2007 052 655

(51) Int. Cl.
*H01H 3/02* (2006.01)

(52) U.S. Cl. ..... 200/529; 200/339

(58) Field of Classification Search ..... 200/529
See application file for complete search history.

(56) References Cited

U.S. PATENT DOCUMENTS

| | | | | |
|---|---|---|---|---|
| 5,357,071 | A | 10/1994 | Hanaki | |
| 5,426,275 | A | 6/1995 | Maeda et al. | |
| 5,496,977 | A * | 3/1996 | Date et al. | 200/6 A |
| 5,691,580 | A | 11/1997 | Shelby | |
| 5,902,972 | A * | 5/1999 | Nestor et al. | 200/1 B |
| 6,150,808 | A | 11/2000 | Yagyu et al. | |
| 6,693,246 | B1 | 2/2004 | Rudolph et al. | |
| 7,285,740 | B2 * | 10/2007 | Nakajima | 200/339 |
| 2006/0102453 | A1 * | 5/2006 | Miyauchi | 200/5 R |

FOREIGN PATENT DOCUMENTS

| | | |
|---|---|---|
| DE | 4326226 | 2/1994 |
| DE | 19627294 | 1/1998 |
| DE | 19837895 | 2/2000 |
| DE | 19946020 | 3/2001 |
| DE | 10110648 | 9/2002 |
| DE | 102005024221 | 12/2006 |
| EP | 0797302 | 9/1997 |
| EP | 1239497 | 9/2002 |
| ES | 2204873 | 9/2002 |
| FR | 2882188 | 2/2005 |
| JP | 5-77835 | 10/1993 |
| JP | 8083535 | 3/1996 |
| JP | 10125179 | 5/1998 |
| JP | 2005032678 | 3/2005 |
| KR | 1997-0000114 | 1/1993 |
| WO | 2006125558 | 11/2006 |

* cited by examiner

*Primary Examiner* — Edwin A. Leon
*Assistant Examiner* — Lheiren Mae Caroc
(74) *Attorney, Agent, or Firm* — Tarolli, Sundheim, Covell & Tummino LLP

(57) ABSTRACT

In a switch, particularly a window lifter switch, with a housing, a switching rocker which is mounted in the housing and is associated with electrical contacts, and with a button which is likewise mounted in the housing, the button is acted upon elastically so that it is mounted free from play in the housing.

18 Claims, 4 Drawing Sheets

SWITCH, PARTICULARLY WINDOW LIFTER SWITCH

FIELD OF THE INVENTION

The invention relates to a switch, particularly a window lifter switch.

BACKGROUND OF THE INVENTION

A known switch has a housing, a switching rocker which is mounted in the housing and is associated with electrical contacts, and a button which is likewise mounted in the housing.

By actuating the button, the switching rocker is moved which, in turn, then actuates one of the electrical contacts. The actuation of the button can usually take place in two directions, for example pushing and pulling, whereby different contacts are connected. Each of the contacts can generally be switched in two stages, for example in a first stage with a light actuating force and in a second stage with a greater actuating force or a greater stroke of the button. In this way, for example, a window lifter motor can be actuated in the desired direction, i.e. opening or closing of the window pane, and in the desired type of operation, in order for example to be actuated manually, as long as the corresponding button is held or complete opening or closing of the window pane, even after the button as been released.

A problem in such switches is that the button basically tends to rattle. In particular owing to the unavoidable vibrations in a motor vehicle, an undesired noise is then generated in the interior of the vehicle.

BRIEF SUMMARY OF THE INVENTION

It is an object of the invention to further develop a switch of the type initially mentioned to the effect that rattling noises are avoided.

To achieve this object, in a switch, particularly a window lifter switch, with a housing, a switching rocker which is mounted in the housing and is associated with electrical contacts, and with a button which is likewise mounted in the housing, the button is acted upon elastically so that it is mounted free from play in the housing. In this way, the undesired vibrations are reliably prevented.

A switching mat is preferably provided, which is provided with the electrical contacts and with which the switching rocker cooperates, the switching mat acting upon the rocker elastically against the button. In this embodiment, no additional structural element is necessary in order to act upon the button elastically so that it is free of play. Owing to its characteristics, the switching mat is readily able to permanently provide the necessary elastic pre-stressing.

"Free of play" is understood here to mean a state in which the button has no play relative to the housing in the case of the vibrations which usually occur. It stands to reason that when greater stresses occur, the button can definitely have a play in the housing, for example when it is moved by a user in opposition to the elastic application force.

The rocker is preferably mounted in the housing so that it is displaceable towards the button. In this way, it can transfer the elastic application force provided from the switching mat directly onto the button.

According to the preferred embodiment of the invention, provision is made that the button is mounted in the housing by means of a two-point bearing. "Two-point bearing" is understood here to mean a bearing which has two bearing points or bearing surfaces which are separated from each other spatially, in which with a relative movement between the button and the housing in one direction, a movement takes place about the one bearing point or the one bearing surface, whereas with a relative movement in the opposite direction, a movement takes place about the other bearing point or the other bearing surface. Unlike a conventional swivel bearing, in which the relative movement between two components always takes place about the same swivel axis, in a two-point bearing there are two different movement axes depending on the direction of movement. This can be seen in the example of a cube which stands on a flat base. If the cube is to be tilted in one direction, it tilts over the corresponding outer edge of its underside, which touches the base. With a movement in the opposite direction, the cube tilts about the opposite outer edge of the underside, i.e. about a spatially distanced axis. The use of a two-point axis offers the critical advantage that it automatically forms a precise defined middle position into which the button is acted upon. In a comparable manner to the cube which has been discussed, which due to its weight experiences a force bringing it into a position in which it rests with its entire underside on the base, the elastic pre-stressing acting upon the button to bring it into a position in which the two bearing points or bearing surfaces are uniformly stressed. This is particularly advantageous when two switches are arranged adjacent to each other or the switch is constructed as a double switch. A slight malposition of the button in the neutral position would in this case already be negatively noticed. The neutral position precisely defined by the two-point bearing ensures that the buttons assume exactly the same position in the unactuated position.

A further advantage which is connected with the use of the two-point bearing consists in that comparatively high elastic pre-stressing forces can be applied by the switching mat, without the risk occurring that the button is deflected in an undesired manner out from its neutral position. Owing to unavoidable manufacturing tolerances, the risk occurs in every switch that the elastic pre-stressing force applied by the switching mat does not act exactly on a line which runs through the mid-point of the connection between the switching rocker and the button on the one hand and the bearing between button and housing on the other hand. If a conventional journal bearing were used for the bearing of the button in the housing, a slight deviation of the direction of action of the elastic pre-stressing force from the ideal path would generate a torque which attempts to deflect the button out from its neutral position. This torque is determined by the lever arm, i.e. the shorter distance between the direction of action of the elastic pre-stressing force and the mid-point of the journal bearing, multiplied by the pre-stressing force. However, the two-point bearing has two bearing points or bearing surfaces which lie at a distance from each other on one side or the other of the middle line and theoretical line of action of the elastic pre-stressing force. As long as the actual direction of action of the elastic pre-stressing force runs anywhere between the two bearing points or bearing surfaces, no torque is produced which attempts to move the button out from its neutral position. The two-point bearing in fact ensures that the button remains in a stable manner in its neutral position.

Such a two-point bearing can preferably be formed by a journal pin and a bearing surface, in which the journal pin has on its side facing the switching mat a geometry which deviates from the circular shape, when viewed in cross-section, and in particular has a generally rectangular cross-section. This ensures that the two edges lying on the one and the other side of the middle line act as swivel axes of the two-point bearing. Preferably bearing surfaces which are arranged in a V-shape and receive the journal pin between them cooperate with the two edges of the journal pin.

To improve the centering of the switching rocker relative to the button, a play-free abutment is preferably formed between the switching rocker and the button. This can be realized by an abutment pin which engages into an abutment fork which is provided with two abutment surfaces arranged in a V-shape.

Advantageous embodiments of the invention will be apparent from the sub-claims.

SHORT DESCRIPTION OF THE DRAWINGS

DETAILED DESCRIPTION OF A PREFERRED EMBODIMENT

Figure 1:
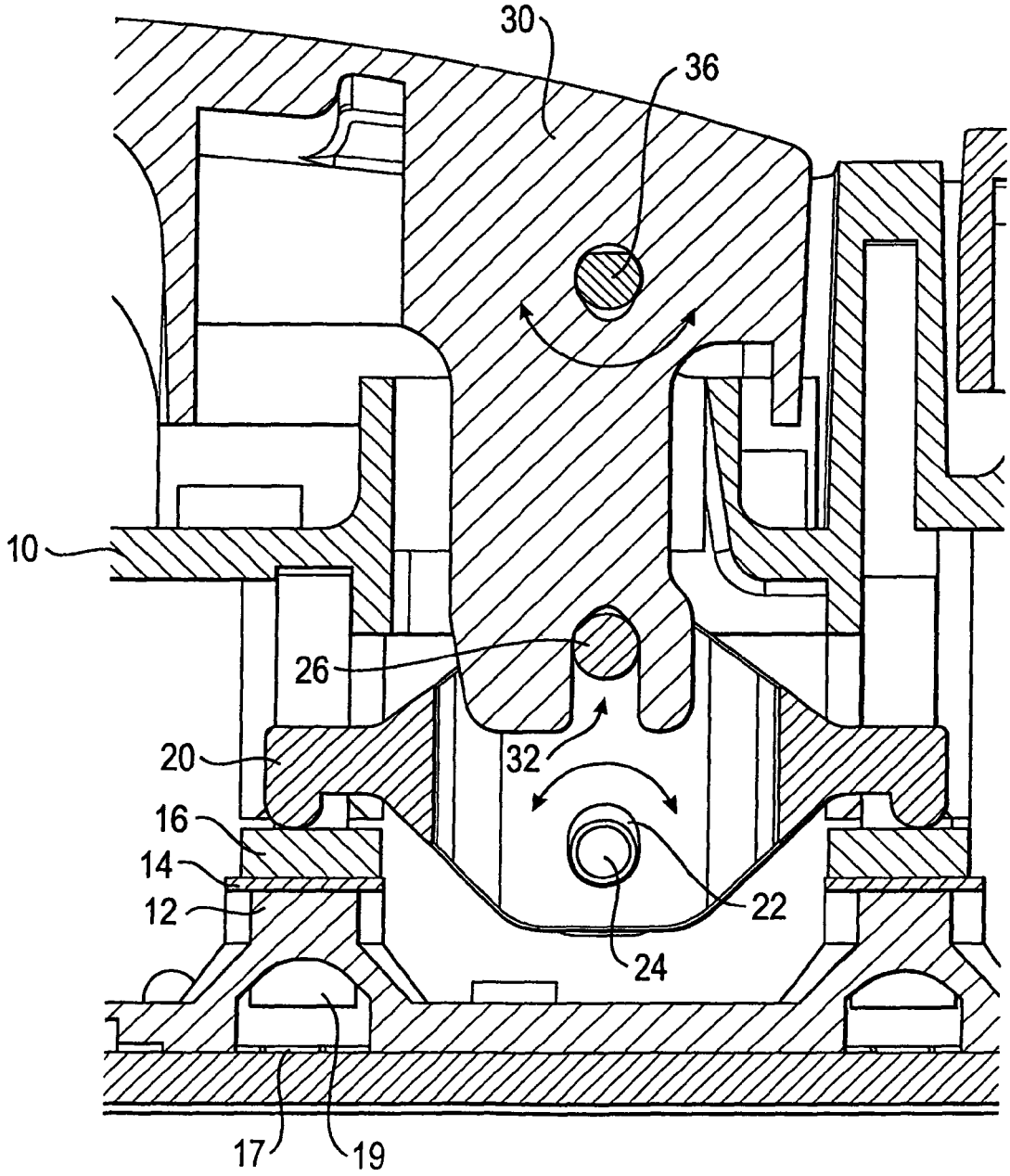
FIG. 1 shows a diagrammatic section through a switch according to the invention.

In FIG. 1 a cross-section through a switch is shown, which can be used in particular as a two-stage pull/push window lifter switch. It has a housing 10 in which a switching mat 12, a switching rocker 20 and a pull/push button 30 are arranged.

The switching mat 12 is associated with a metal plate 14 which can be pressed downwards by an actuating striker 16. The actuating striker 16 is arranged in the ratio 1/3 to 2/3 eccentrically on the metal plate, so that two contacts can be actuated in two stages. The contacts are arranged one behind the other with respect to FIG. 1, i.e. the second covered by the first behind the plane of the drawing, and respectively formed by conductor paths 17 on a conductor path and a contact pill 19 on the switching mat. Owing to the eccentric arrangement of the actuating striker 16, the contact to which the actuating striker is more closely arranged will switch first.

The switching rocker 20 has an oblong hole 22 into which a bearing pin 24 engages which is mounted on the housing 10 or part of the housing. The switching rocker has, in addition, an abutment pin 26 which has a circular cross-section and cooperates with the button 30.

For this purpose, the button 30 is provided with an abutment fork which has two abutment surfaces 34 which are aligned in a V-shape (see also FIG. 4), between which the abutment pin 26 is arranged.

The button 30 is mounted in the housing 10 by a journal pin 36 which is mounted on the housing or part of the housing. The button 30 has an opening 38 into which the journal pin 36 engages. On its side facing the switching mat 12, the opening 38 is provided with two bearing surfaces 40 (see also FIG. 4), which face each other obliquely, so that a concave region is formed. The journal pin 36 has a generally rectangular form, viewed in cross-section, with two corners which face the switching mat 12. The upper flattening is constituted as a chamfer in section. The lateral flattenings are provided in order to prevent any possible injection burrs from leading to the journal pin jamming. The mould separation plane of the injection mould in fact extends through the journal pin. The flattenings ensure that any injection burrs which may be present can not jam on the opposite surface of the button.

Figure 4:
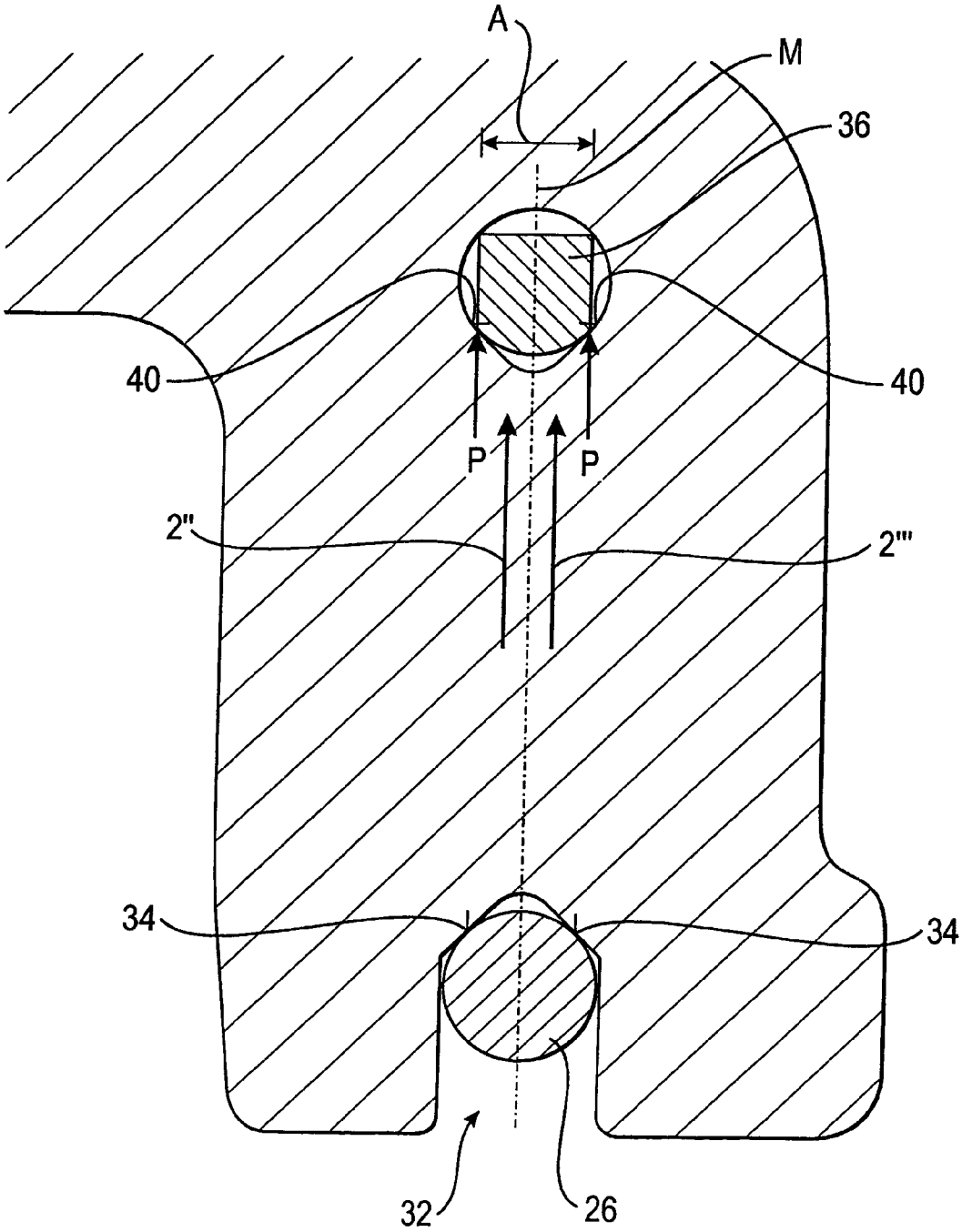
FIG. 4 shows the mounting of the button on an enlarged scale.

Through the cross-sectional shape of the journal pin 36, a two-point bearing is provided between the button 30 and the housing 10, because the button 30 rests on the journal pin 36 in two points P (see FIG. 4) or, viewed three-dimensionally, along two bearing edges which run through the points P of FIG. 4 and extend perpendicularly to the plane of the drawing. These two bearing edges are arranged at a distance A from each other on the one and the other side of a middle line M which extends through the mid-point of the two-point bearing, formed by journal pin 36 and opening 38, and the abutment, formed by abutment pin 26 and abutment surfaces 34.

When the button 30 is actuated, it swivels in accordance with the actuating direction about the journal pin 36. The abutment fork 32 is thereby swiveled, whereby the abutment pin 26 is entrained. This leads to a tilting movement of the switching rocker 20 about the bearing pin 24, so that the switching rocker presses onto one or other contact of the switching mat 12.

An essential feature of the switch is that the button 30 is acted upon by an elastic pre-stressing force, so that it is free of play. This pre-stressing force is produced through the switching mat 12 which, in the initial state, is held in a compressed state in the vertical direction in relation to FIG. 1. The switching mat therefore exerts via its metal plates an upwardly directed force onto the switching rocker 20 (see arrows 1 in FIG. 2), whereby the switching rocker 20 is pressed upwards. This is possible because the switching rocker is mounted on the housing 10 by means of the oblong hole 22 so as to be displaceable in the vertical direction. The upward movement of the switching rocker leads to the abutment pin 26 being pressed into the abutment fork 32 of the button 30 and against the abutment surfaces 34. Finally, an upwardly directed force is thereby generated, which presses the button 30 in the direction of arrow 2 of FIG. 2 against the journal pin 36. The corresponding, oppositely directed bearing force (see arrows 3 of FIG. 2) is transferred from the bearing surfaces 40. The button 30 is thereby held free from play in the housing 10, because its bearing surface 40 is pressed against the journal bearing 36 by the elastic pre-stressing force provided by the switching mat 12.

Figure 2:
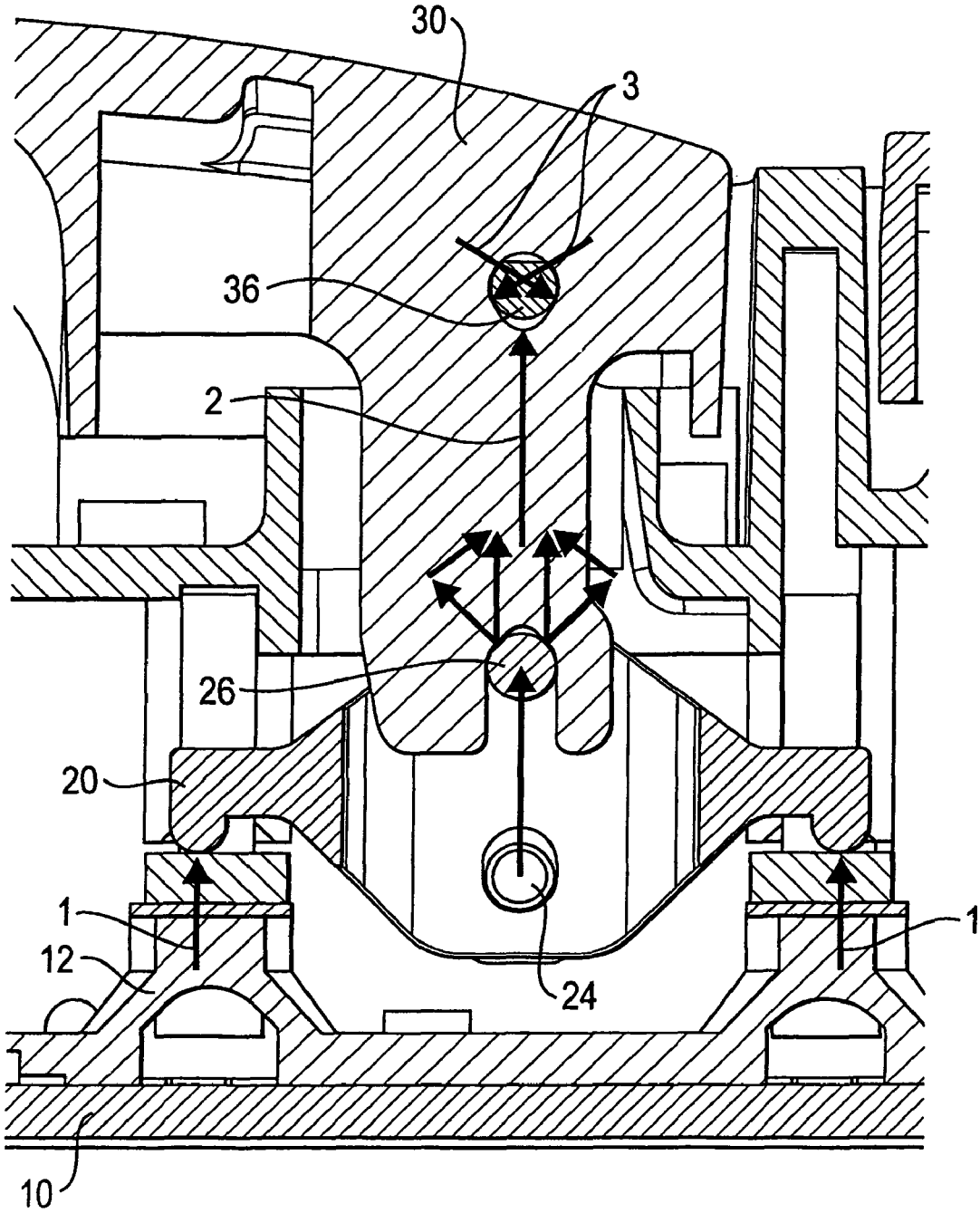
FIG. 2 shows a view corresponding to that of FIG. 1, in which the acting forces are illustrated in the theoretical neutral position of the switch.
Figure 3:
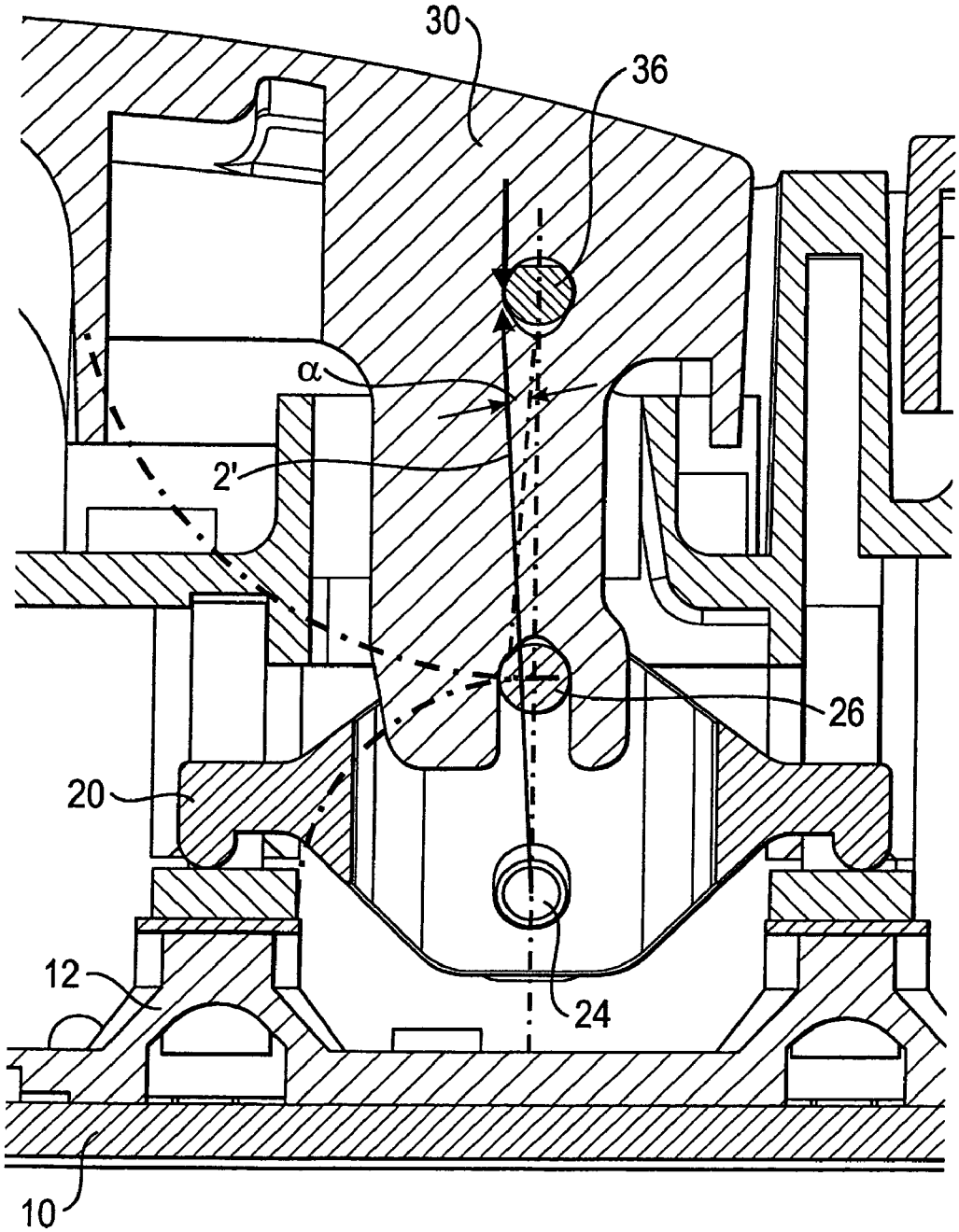
FIG. 3 shows a view corresponding to that of FIG. 1, in which the acting forces are illustrated in a neutral position of the switch occurring in practice.

The theoretical path of force is shown in FIG. 2. The direction of action of the arrow 2 coincides here with the middle line M between the abutment between switching rocker and button on the one hand and the bearing between housing and button on the other hand. As long as the line of action runs through the middle axis in particular of the bearing 36/40, it is clear that the pre-stressing force can not exert any torque onto the button 30. In practice, however, owing to manufacturing tolerances it can not be guaranteed that the direction of action of the pre-stressing force runs exactly through the mid-point of the bearing 36/40. In FIG. 3, the direction of action of the pre-stressing force is drawn as arrow 2', as it would be aligned in the case of very great tolerances. The line of action of the pre-stressing force runs here exactly through the contact point P between the left outer edge of the journal pin 36 and the bearing surface 40. This means that the button 30 is still reliably supported by the journal pin 36 without a torque acting on the button 30. As long as the direction of action of the elastic pre-stressing force lies "inside" the two contact points P (see the arrows 2" and 2'" in FIG. 4) or, as in the extreme case shown in FIG. 3, runs precisely through one of the contact points P, the two-point bearing can receive the elastic pre-stressing force without a torque acting on the button 30. The result of this is that the button is always acted upon by the elastic pre-stressing force into the same neutral position even in the case of possible position tolerances of the parts with respect to each other.

The invention claimed is:

1. A switch comprising:

a housing (10), a switching rocker (20) which is mounted in the housing (10) and is associated with electrical contacts (14), and a button (30) which is mounted in the housing (10) by a two-point bearing (36, 40), a first bearing point (36 or 40) and a second bearing point (36 or 40) of the two-point bearing (36, 40) have pivot axes that are spaced from one another, the button (30) being acted upon elastically so that the button (30) is mounted free from play in the housing (10).

2. The switch according to claim 1, wherein a switching mat (12) is provided which is provided with the electrical contacts (14) and with which the switching rocker (20) cooperates, the switching mat (12) acting upon the switching rocker (20) elastically against the button (30).

3. The switch according to claim 1, wherein the switching rocker (20) is mounted in the housing (10) so that the switching rocker (20) is displaceable relative to the housing (10) towards the button (30) when the switching rocker (20) and the button (30) are mounted in the housing (10).

4. The switch according to claim 1, wherein the switching rocker (20) has an oblong hole (22) into which a bearing pin (24) engages, the bearing pin (24) being mounted on the housing (10).

5. The switch according to claim 1, wherein the two-point bearing has two support points (P) between button (30) and housing (10) which are arranged on the one and the other side of a middle line (M) which runs through the middle of the two-point bearing and the connection between the button (30) and the switching rocker (20).

6. The switch according to claim 1, wherein an abutment (26, 32, 34) which is free of play is formed between the switching rocker (20) and the button (30).

7. The switch according to claim 6, wherein the switching rocker (20) is provided with an abutment pin (26) and the button (30) is provided with an abutment fork (32).

8. The switch according to claim 1, wherein the two-point bearing has first and second bearing points, the button (30) being pivotable relative to the housing (10) about the first bearing point of the two-point bearing (36 or 40) relative to the second bearing point (36 or 40), the button (30) being pivotable relative to the housing (10) about the second bearing point of the two-point bearing (36 or 40) relative to the first bearing point (36 or 40).

9. The switch according to claim 1, wherein the two-point bearing (36, 40) includes two bearing edges extending generally parallel to each other.

10. The switch according to claim 1, wherein the two-point bearing is formed between a single journal pin (36) integral with the housing (10) and a bearing surface (40) on the button (30).

11. The switch according to claim 10, wherein the button (30) is pivotable relative to the journal pin (36).

12. A switch comprising:

a housing (10), a switching rocker (20) which is mounted in the housing (10) and is associated with electrical contacts (14), and a button (30) which is mounted in the housing (10) by a two-point bearing (36, 40), the button (30) pivoting relative to the housing (10) about at least one point of the two-point bearing (36, 40), wherein the two-point bearing is formed by a journal pin (36) rigidly fixed to the housing (10) and a bearing surface (40) through which the journal pin (36) extends defined by an opening in the button (30) and, in which the journal pin (36) has on a side of the journal pin (36) facing a switching mat (12) a geometry deviating from a circular shape, observed in cross-section.

13. The switch according to claim 12, wherein the journal pin (36) has a generally rectangular cross-section.

14. The switch according to claim 12, wherein the journal pin (36) is associated with the housing (10) and the button (30) is provided with two bearing surfaces (40) which lie against the journal pin (36).

15. The switch according to claim 12, wherein the side of the journal pin (36) that engages the bearing surface (40) to form the two-point bearing (36, 40) faces the switching mat (12).

16. A switch comprising:

a housing (10), a switching rocker (20) which is mounted in the housing (10) and is associated with electrical contacts (14), and a button (30) which is mounted in the housing (10), the button (30) being acted upon elastically so that the button (30) is mounted free from play in the housing (10), the button (30) being mounted in the housing (10) by a two-point bearing (36, 40) formed by a journal pin (36) and a bearing surface (40), in which the journal pin (36) has on a side of the journal pin (36) facing the switching mat (12) a geometry deviating from a circular shape, observed in cross-section, the journal pin (36) being associated with the housing (10) and the button (30) being provided with two bearing surfaces (40) which lie against the journal pin (36), wherein the two bearing surfaces (40) are arranged in a V-shape and receive the journal pin (36) between them.

17. A switch comprising:

a housing (10), a switching rocker (20) which is mounted in the housing (10) and is associated with electrical contacts (14), and a button (30) which is mounted in the housing (10), the button (30) being acted upon elastically so that the button (30) is mounted free from play in the housing (10), wherein an abutment (26, 32, 34) which is free of play is formed between the switching rocker (20) and the button (30), the switching rocker (20) being provided with an abutment pin (26) and the button (30) being provided with an abutment fork (32), the abutment fork (32) having two abutment surfaces (34) arranged in a V-shape, which receive the abutment pin (26) between them.

18. A switch comprising:

a housing (10), a switching rocker (20) which is mounted in the housing (10) and is associated with electrical contacts (14), and a button (30) which is mounted in the housing (10) by a two-point bearing (36, 40), wherein a first bearing point (36 or 40) and a second bearing point (36 or 40) of the two-point bearing (36, 40) have pivot axes that are spaced from one another, the button (30) pivoting relative to the housing (10) about at least one point of the two-point bearing (36, 40), wherein the two-point bearing is formed by a journal pin (36) and a bearing surface (40), in which the journal pin (36) has on a side of the journal pin (36) facing a switching mat (12) a geometry deviating from a circular shape, observed in cross-section.

* * * * *